US010577930B2

(12) United States Patent
Tao

(10) Patent No.: US 10,577,930 B2
(45) Date of Patent: Mar. 3, 2020

(54) THERMAL MANAGEMENT VIA FLOWLINE HEAT DISSIPATION

(71) Applicant: Schlumberger Technology Corporation, Sugar Land, TX (US)

(72) Inventor: Chen Tao, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 725 days.

(21) Appl. No.: 14/955,438

(22) Filed: Dec. 1, 2015

(65) Prior Publication Data

US 2017/0152735 A1 Jun. 1, 2017

(51) Int. Cl.
*E21B 49/10* (2006.01)
*E21B 47/01* (2012.01)

(52) U.S. Cl.
CPC ..... *E21B 49/10* (2013.01); *E21B 47/011* (2013.01)

(58) Field of Classification Search
CPC ..... E21B 49/10; E21B 47/011
USPC ..... 166/264
See application file for complete search history.

(56) References Cited

U.S. PATENT DOCUMENTS

| | | | | |
|---|---|---|---|---|
| 7,806,173 | B2 | 10/2010 | Kaul et al. | |
| 8,448,703 | B2 | 5/2013 | Ross et al. | |
| 8,567,500 | B2 * | 10/2013 | Bedouet | E21B 47/011 166/302 |
| 2008/0314638 | A1 * | 12/2008 | Kaul | E21B 47/011 175/17 |
| 2011/0114310 | A1 | 5/2011 | Ross et al. | |

* cited by examiner

*Primary Examiner* — Anna M Momper
*Assistant Examiner* — Patrick F Lambe
(74) *Attorney, Agent, or Firm* — Trevor G. Grove

(57) ABSTRACT

An apparatus that includes a housing, a flowline extending within the housing, and a member retained within the housing and substantially comprising thermally conductive material. The flowline is retained in a substantially cylindrical surface of the member. A heat-generating electrical component is mounted to the member.

9 Claims, 4 Drawing Sheets

THERMAL MANAGEMENT VIA FLOWLINE HEAT DISSIPATION

BACKGROUND OF THE DISCLOSURE

During and/or after drilling operations, different tools may be included in a tool string or downhole tool to evaluate a subterranean formation or perform other tasks. Some of these tools include electronic or moving parts that generate heat. In some instances, the heat may decrease the functionality of these tools or cause them to fail. Such instances may be exacerbated when using the tools in high temperature wells.

SUMMARY OF THE DISCLOSURE

This summary is provided to introduce a selection of concepts that are further described below in the detailed description. This summary is not intended to identify indispensable features of the claimed subject matter, nor is it intended for use as an aid in limiting the scope of the claimed subject matter.

The present disclosure introduces an apparatus that includes a downhole tool for conveyance within a wellbore extending into a subterranean formation. The downhole tool includes a housing, a flowline extending within the housing, and a chassis having a member substantially comprising thermally conductive material. The flowline is retained in a substantially cylindrical surface of the member. The downhole tool also includes a heat-generating electrical component mounted to the member.

The present disclosure also introduces a method that includes conveying a downhole tool within a wellbore extending into a subterranean formation. The downhole tool includes a housing, a flowline extending within the housing, and a chassis having a member substantially comprising thermally conductive material. The flowline is retained in a substantially cylindrical surface of the member. The downhole tool also includes a heat-generating electrical component mounted to the member. The method also includes pumping a fluid from the subterranean formation through the flowline to dissipate heat transferred from the heat-generating electrical component to the fluid through the member and the flowline.

The present disclosure also introduces an apparatus that includes a housing, a flowline extending within the housing, and a member retained within the housing and substantially comprising thermally conductive material. The flowline is retained in a substantially cylindrical surface of the member. The apparatus also includes a heat-generating electrical component mounted to the member.

These and additional aspects of the present disclosure are set forth in the description that follows, and/or may be learned by a person having ordinary skill in the art by reading the materials herein and/or practicing the principles described herein. At least some aspects of the present disclosure may be achieved via means recited in the attached claims.

BRIEF DESCRIPTION OF THE DRAWINGS

The present disclosure is understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
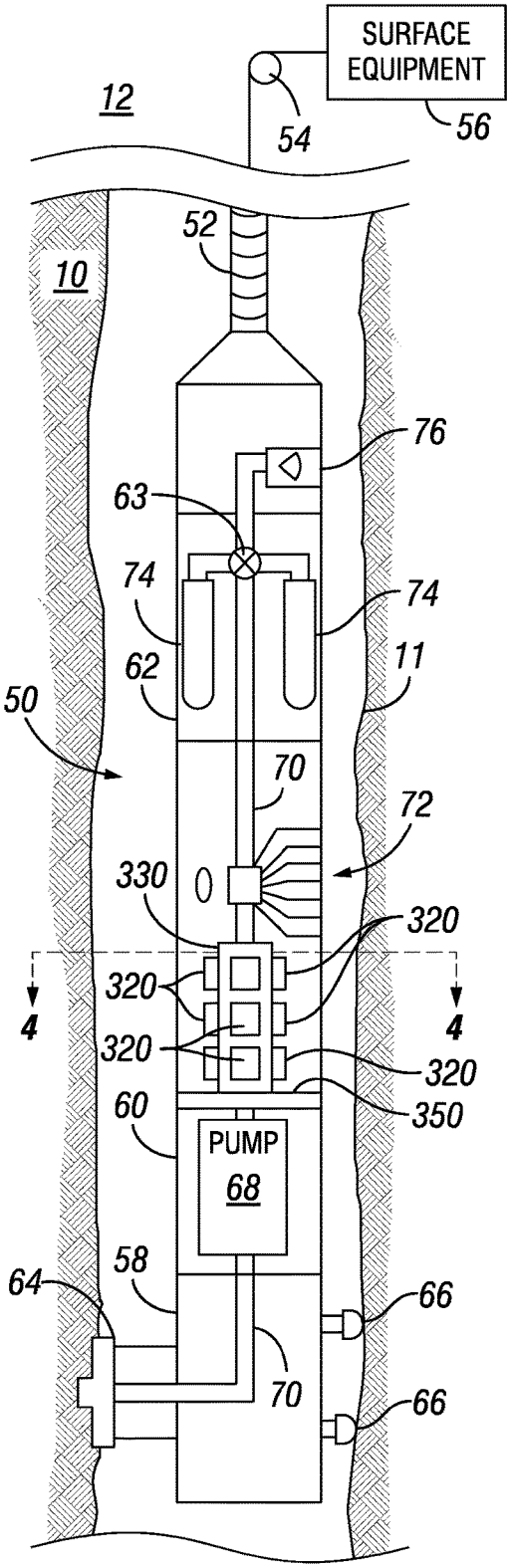
FIG. 1 is a schematic view of at least a portion of an example implementation of apparatus according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for simplicity and clarity, and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. It should also be understood that the terms "first," "second," "third," etc., are arbitrarily assigned, are merely intended to differentiate between two or more parts, and do not indicate a particular orientation or sequence. As used herein, a "fluid" is a homogenous or heterogeneous liquid and/or gas that tends to flow and conform to the outline of its container when at atmospheric pressure and a temperature of 22° C.

Examples implementations of apparatus described herein relate generally to a cooling system for dissipating heat away from a heat-generating component of a downhole tool, among other uses. The cooling system utilizes a flowline located within a chassis of the downhole tool. Drilling and/or formation fluid is directed through the flowline during normal operations of the downhole tool. Heat from a heat-generating component coupled to the chassis is dissipated by transfer from the heat-generating component to the fluid in the flowline through the chassis. Examples implementations of methods described herein relate generally to utilizing fluid flow through the flowline to dissipate heat from the heat-generating component.

FIG. 1 is a schematic via of at least a portion of an example implementation of downhole equipment operable to sample fluid from a subterranean formation 10. The downhole equipment includes an example implementation of a downhole formation fluid sampling tool 50, hereinafter referred to as the downhole tool 50. The downhole tool 50 is conveyed within a wellbore 11 to the subsurface formation 10 and subsequently operated to pump formation fluid from the formation 10, initially during a cleanup operation, and then to collect a sample of the formation fluid in a sample chamber 74.

In the illustrated example, the downhole tool 50 is conveyed in the wellbore 11 via a wireline 52, such as may be a multi-conductor cable spooled from a winch 54 at a wellsite surface 12 from which the wellbore 11 extends. The wireline 52 may be electrically coupled to wellsite surface equipment 56, such as to communicate various control signals and logging information between the downhole tool 50 and the wellsite surface equipment 56.

The downhole tool 50 includes a probe module 58, a pumpout module 60, and a sample module 62. However, other arrangements and/or modules can make up the downhole tool 50.

The probe module 58 comprises a fluid communicator, such as a probe 64, to fluidly seal against and otherwise engage the formation 10 for communicating fluid from the formation 10 into the downhole tool 50. The probe 64 and/or other fluid communication may be extendable from the downhole tool 50 into contact the sidewall of the wellbore 11. However, the probe module 58 may also or instead comprise one or more setting mechanisms 66. The setting mechanisms 66 may comprise pistons and/or other apparatus to improve sealing engagement and thus fluid communication between the formation 10 and the probe 64. Whether instead of or in addition to the probe 64, the probe module 58 may comprise one or more packer elements (not shown) that mechanically and/or hydraulically expand or are swellable to contact the sidewall of the wellbore 11, thereby isolating a section of the wellbore 11 for sampling. The probe module 58 may also comprise electronics, batteries, sensors, and/or hydraulic components used, for example, to operate the probe 64 and the corresponding setting mechanisms 66.

The pumpout module 60 may comprise a pump 68 operable to create a pressure differential that draws the formation fluid in through the probe 64 and pushes the fluid through a flowline 70 of the downhole tool 50. The pump 68 may be or comprise an electromechanical, hydraulic, and/or other type of pump operable to pump formation fluid from the probe module 58 to the sample module 62, including to out of the downhole tool 50 and into the wellbore 11 via an exit port 76. The pump 68 may operate as a piston displacement unit (DU) driven by a ball screw coupled to a gearbox and an electric motor, although other types of pumps 68 are also within the scope of the present disclosure. Power may be supplied to the pump 68 via other components located in the pumpout module 60, or via a separate power generation module (not shown).

The pump 68 moves the fluid past heat-generating components 320 that may operate to power or control the pump 68. The heat-generating components 320 may be retained within a housing 61 of the pumpout module 60 via connection to a chassis 330 that is secured to the housing 61 by one or more attachments 350. During a sampling operation, the pump 68 moves the formation fluid through the flowline 70 toward the sample module 62.

The pumpout module 60 and/or another portion of the downhole tool 50 may also comprise a fluid analyzer 72. The fluid analyzer 72 may be or comprise a spectrometer operable to measure characteristics of the formation fluid as it flows through the flowline 70. The fluid analyzer 72 may be located downstream (as depicted) or upstream of the pump 68. The fluid analyzer 72 may sense optical density (OD) of the formation fluid. Data collected via the fluid analyzer 72 may be utilized to control the downhole tool 50. For example, the downhole tool 50 may operate in a pumpout or "cleanup" mode until the formation fluid flowing through the flowline 70 (and back into the wellbore 11 via the exit port 76) exhibits characteristics of a clean formation fluid sample, such as when the pumped fluid substantially comprises native formation fluid with minor amounts of drilling fluid and/or other contaminants, as detected by or otherwise determined in conjunction with operation of the fluid analyzer 72 and/or other sensors of the downhole tool 50. Sampling may then commence, such as by controlling a valve 63 to redirect flow in the flowline to one or more sample containers 74, instead of to the wellbore via the exit port 76.

The sample module 62 may comprise one or more sample containers 74 for collecting samples of the formation fluid. The sample containers 74 may be filled one at a time, and once a sample container 74 is filled, its corresponding valve may be moved to a closed position to seal the sample container 74.

In the cleanup mode, the pump 68 moves the formation fluid into the downhole tool 50 through the probe 64 or other fluid communicator, through the flowline 70, and then out of the downhole tool 50 and into the wellbore 11 through the exit port 76. The exit port 76 may be a check valve that releases the formation fluid into the wellbore 11 but prevents the entry of drilling and other wellbore fluid from the wellbore 11. The downhole tool 50 may operate in the cleanup mode until the formation fluid flowing through the flowline 70 is determined to be clean enough for sampling. That is, when the formation fluid is first sampled, drilling fluid that had been forced into the formation 10 via the drilling operations contaminates the fluid obtained from the formation. After pumping fluid from the formation for a sufficient amount of cleanup time, the formation fluid flowing through the downhole tool 50 will provide a cleaner fluid sample from the formation 10. For example, the formation fluid may be considered clean when the OD data from the fluid analyzer 72 indicates that the formation fluid contains less than approximately 1%, 5%, or 10% filtrate contamination (by weight or volume), although other values are also within the scope of the present disclosure.

The characteristics of the formation fluid measured by the fluid analyzer 72 may be utilized to perform a variety of evaluation and control functions, in addition to determining when the formation fluid flowing through the flowline 70 is clean enough for sampling. For example, data may be collected from the fluid analyzer 72 and/or other sensors within the downhole tool, such as a density sensor, a viscosity sensor, a pressure sensor, a temperature sensor, and/or a saturation pressure sensor, among others. The collected data may be utilized to estimate a formation volume factor (FVF), density, gas-to-oil ratio (GOR), compressibility, saturation pressure, viscosity, and/or mass fractions of compositional components of the formation fluid and/or contaminants therein (e.g., oil-based mud (OBM) filtrate), among others.

Figure 2:
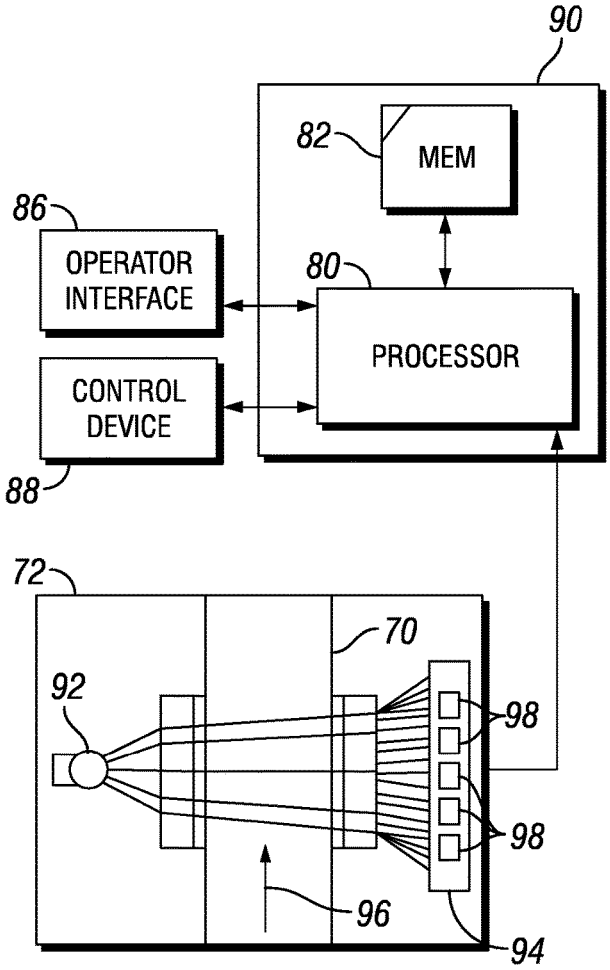
FIG. 2 is a schematic view of a portion of the apparatus shown in FIG. 1.

FIG. 2 is a schematic view of the fluid analyzer 72 and a control/monitoring system 90 that can be utilized to estimate or determine such properties. The fluid analyzer 72 may comprise a light source 92 and a detector 94 located on opposite sides of the flowline 70 through which the formation fluid flows, as indicated by arrow 96. The fluid analyzer 72 may be located at various possible locations along the flowline 70 that directs the formation fluid through the downhole tool 50. Although a single light source 92 is depicted in the example shown in FIG. 2, the fluid analyzer 72 may include additional light sources 92. The detector 94 is operable to sense the light that passes through the formation fluid in the flowline 70, perhaps through one or more sampling windows (not shown) located along the flowline 70.

The detector 94 may comprise one or more detector elements 98 that may each be utilized to measure the amount of light transmitted at a certain wavelength. For example, the detector elements 98 may detect the light transmitted from the visible to near-infrared within a range of 1, 5, 10, 20, or more different wavelengths ranging between about 400 nanometers (nm) and about 2,200 nm. However, other numbers and/or ranges of wavelengths are also within the scope of the present disclosure.

The fluid analyzer 72 may output optical spectra and/or other data representative of the detected optical characteristics. The optical characteristics may include OD of the formation fluid at each of the detected wavelengths and/or wavelength ranges. Each wavelength or wavelength range may correspond to a compositional component of the formation fluid. For example, each wavelength or wavelength range may pertain to a corresponding one of carbon dioxide, methane, ethane, propane, butane, pentane, and hexane, although other arrangements are also within the scope of the present disclosure.

The fluid analyzer 72 may send optical spectra and/or other data representative of the measured optical characteristics to a processor 80 of the control/monitoring system 90. In the context of the present disclosure, the term "processor" refers to any number of processor components. The processor 80 may comprise a single processor disposed onboard the downhole tool 50. In other implementations, at least a portion of the processor 80 (e.g., multiple processors collectively operating as the processor 80) may be located within the wellsite surface equipment 56 and/or other surface equipment components.

The processor 80 may be communicatively coupled with one or more operator interfaces 86 and/or control devices 88. The operator interface 86 may provide for access by a human operator, whether for logging, control, and/or other utilization. The control device 88 may provide control signals for operation based on the estimated properties of the reservoir fluid determined via the fluid analyzer 72 and/or otherwise. Such control signals may implement changes in depth of the downhole tool 50 within the wellbore 11, adjustments to the pumping pressure of the pump 68, and/or other control functions.

Figure 3:
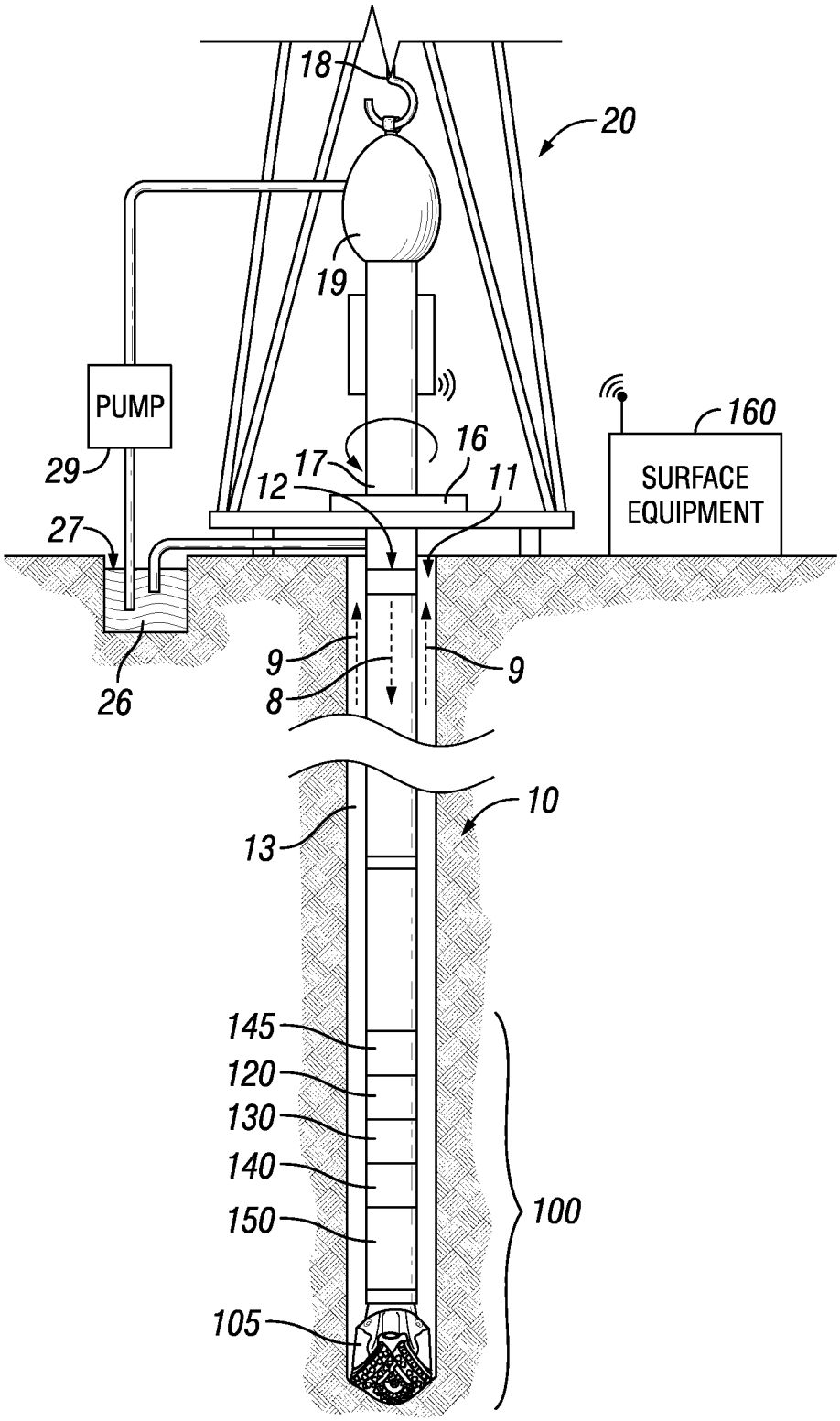
FIG. 3 is a schematic view of at least a portion of an example implementation of apparatus according to one or more aspects of the present disclosure.

FIG. 3 is a schematic view of another example implementation of the downhole tool 50 according to one or more aspects of the present disclosure. That is, one or more aspects of the downhole tool 50 are described above with respect to a wireline implementation. However, such aspects are also applicable or readily adaptable to implementations utilizing conveyance means other than wireline, such as electric line (e-line), slickline, coiled tubing, drill pipe, and others. Thus, FIG. 3 is provided as one such example of a non-wireline implementation—namely, a while-drilling implementation.

The while-drilling system of FIG. 3 can be employed onshore and/or offshore to form the wellbore 11 in one or more subterranean formations 10 by rotary and/or directional drilling. For example, a drill string 12 suspended in the wellbore 11 may comprise a bottom-hole assembly (BHA) 100 having a drill bit 105 at its lower end. A platform and derrick assembly 20 is positioned over the wellbore 11 and supports the drill string 12. The drill string 12 may be rotated by a rotary table 16, which may be energized by a power supply (not shown) that engages a kelly 17 at an upper end of the drill string 12. The kelly 17 and drill string 12 may be suspended from a swivel 19, which is attached to a hook 18 that that travels vertically with a traveling block (not shown). However, a top drive system may be utilized instead of the kelly 17 and rotary table 16.

The while-drilling system of FIG. 3 can be employed onshore and/or offshore to form the wellbore 11 in one or more subterranean formations 10 by rotary and/or directional drilling. For example, a drill string 12 suspended in the wellbore 11 may comprise a bottom-hole assembly (BHA) 100 having a drill bit 105 at its lower end. A platform and derrick assembly 20 is positioned over the wellbore 11 and supports the drill string 12. The drill string 12 may be rotated by a rotary table 16, which may be energized by a power supply (not shown) that engages a kelly 17 at an upper end of the drill string 12. The kelly 17 and drill string 12 may be suspended from a swivel 19, which is attached to a hook 18 that that travels vertically with a traveling block (not shown). However, a top drive system may be utilized instead of the kelly 17 and rotary table 16.

The BHA 100 comprises various numbers and/or types of modules and/or tools. For example, the BHA 100 may comprise a rotary-steerable system 150, one or more modules and/or tools 140 operable for electrical power generation, and/or one or more modules and/or tools 145 operable for telemetry (e.g., mud-pulse telemetry) for communication with surface equipment 160. The surface equipment 160 may comprise a logging and/or control system, among other example components. For example, the surface equipment 160 may comprise a user interface that may display outputs associated with the drilling operations, and that may also permit a human operator to input control parameters.

The BHA 100 also comprises one or more measurement-while-drilling (MWD) and/or logging-while-drilling (LWD) modules and/or tools. In the example implementation depicted in FIG. 3, the BHA 100 comprises an MWD module 120 and an LWD module 130. The MWD module 120 may be operable to measure the azimuth and inclination of the BHA 100, such as may be utilized to monitor trajectory of the wellbore 11. The LWD module 130 may be operable for measuring, processing, and/or storing information pertaining to the formation 10. The LWD module 130 may also be operable for sampling operations, and may thus have one or more aspects in common with the downhole tool 50 described above. For example, although not depicted in FIG. 3, the LWD module 130 may comprise a pump and a fluid communicator (such as a probe) by which fluid may be pumped from the formation into the LWD module 130, as well as downhole fluid analysis means and one or more sample containers for collecting a sample of the formation fluid after sufficient cleanup.

Figure 4:
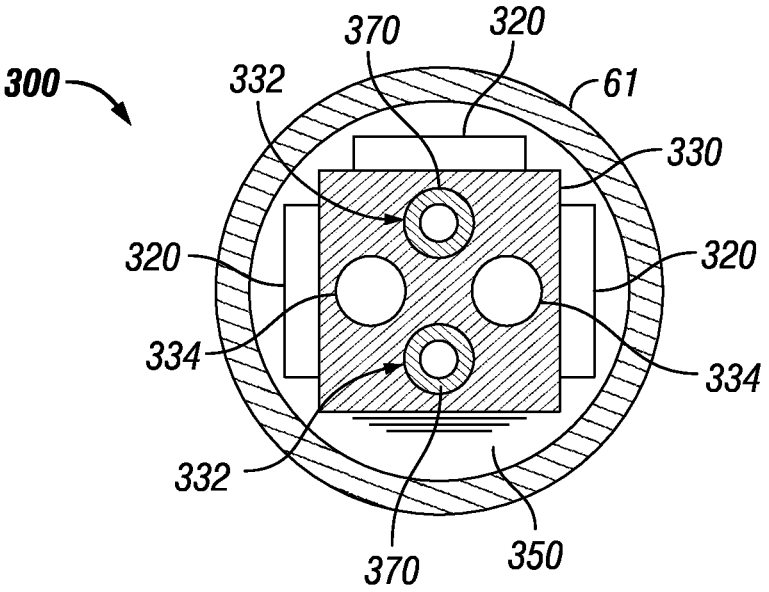
FIG. 4 is a sectional view of an example implementation of the apparatus shown in FIG. 1 according to one or more aspects of the present disclosure.

FIG. 4 is a sectional view of the downhole tool 50 shown in FIGS. 1 and 2, including an example implementation of a cooling apparatus 300 according to one or more aspects of the present disclosure. The following description refers to FIGS. 1 and 4, collectively.

In the example implementation shown in FIG. 4, the downhole tool 50 comprises the housing 61, the chassis 330 secured within the housing 61 by the connection member 350, and the heat-generating electrical components 320 mounted to the chassis 330. The flowline 70 depicted in FIGS. 1 and 2 is depicted in FIG. 4 by dual flowlines 370, each extending longitudinally through the chassis 330.

The housing 310 may be or comprise one or more substantially cylindrical members formed of steel and/or other metals or metal alloys. The connection member 350 comprises a generally disc-shaped portion having an outer diameter substantially similar or equal to an inner diameter of the housing 61, and is secured to the inner surface of the housing 61 via threaded fasteners, adhesive, interference/friction fit, and/or other fastening means. The connection member 350 may be positioned at various locations along the longitudinal length of the chassis 330. Multiple instances of the connection member 350 may secured the chassis 330 within the housing 61.

As described above, the flowlines 370 extend within the housing 61, including through the chassis 330. For example, the flowlines 370 individually or collectively extend from the fluid communicator 64 and/or the pump 68 to the sample chambers 74 and the exit port 76, via the valve 63, including within the housing 310. Each flowline 370 may comprise one or more tubular segments formed of steel, INCONEL, and/or other thermally conductive materials. For example, the flowlines 370 may be formed of a material having a thermal conductivity of at least 100 watts per meter per degree Kelvin (W/m/° K). The higher the thermal conductivity of the flowlines 370, the greater the rate of heat transfer to the fluid flow through the flowlines 370, and thus the greater rate of heat dissipation by the fluid flow.

The chassis 330 is also formed of steel, INCONEL, and/or other thermally conductive materials so as to transfer heat from the heat-generating components 320 to the flowlines 370. For example, the chassis 330 may be formed of a material having a thermal conductivity of at least 100 W/M/° K). As with the flowlines 370, the higher the thermal conductivity of the chassis 330, the greater the rate of heat transfer to the flowlines 370, and thus the greater rate of heat dissipation by the fluid flow within the flowlines 370. The chassis 330 comprises substantially cylindrical passages 332 that receive corresponding ones of the flowlines 370. Thus, the substantially cylindrical outer surface of each flowline 370 may be in substantially surface contact with the substantially cylindrical inner surface of the corresponding one of the passages 332. A thermally conductive paste (not shown) may be utilized between each flowline 370 and the corresponding passage 332 to aid in eliminating air gaps and increasing thermal conduction between the chassis 330 and the flowlines 370. The chassis 330 may also comprise one or more additional passages 334 that remain open for routing electrical cables and the like.

As described above, the heat-generating electrical components 320 may include chips, electrical devices, and other circuitry for driving various components of the downhole tool 50, such as the pump 68. The heat-generating electrical components 320 generate heat sufficient to cause overheating and damage if a flowline cooling system according to aspects of the present disclosure is not utilized. The heat-generating electrical components 320 may be flush-mounted to the chassis 330 such that no gap exists between the heat-generating electrical components 320 and the chassis 330. A thermal paste may also be utilized between the heat-generating components 320 and the chassis 330.

Heat produced by the heat-generating electrical components 320 is conducted to the flowlines 370 via the chassis 330. Fluid flow in the flowlines 370 then dissipates the heat conducted from the heat-generating electrical components 320 as the fluid is pumped through the flowlines 370 and into the wellbore 11 via the exit port 76. For example, if one kilowatt (kW) of power is used to operate the pump 68 at a flow rate of about 10 cubic centimeters per second (cc/sec), approximately 50 W of heat may be produced by the heat-generating components 320. In previous designs, the heat-generating electrical components have been attached to a heat sink that transferred heat to the housing of the downhole tool, such that the heat dissipates into stagnant fluid within the wellbore 11, resulting in a temperature rise within the downhole tool of about 37° C. above the temperature of the stagnant wellbore fluid. However, utilizing the cooling system 300 shown in FIG. 4, and/or other cooling systems according to aspects of the present disclosure, the temperature rise may be limited to about 18° C. above the temperature of the stagnant wellbore fluid. Generally, a higher flow rate of the fluid through the flowlines 370 can dissipate more heat.

Figure 5:
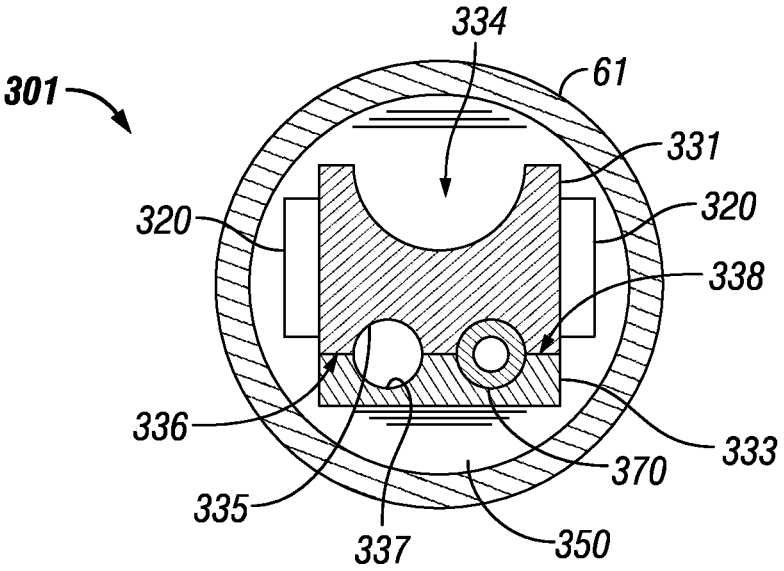
FIG. 5 is a sectional view of another example implementation of the apparatus shown in FIG. 4 according to one or more aspects of the present disclosure.

FIG. 5 is a sectional view of another example implementation of the cooling apparatus 300 shown in FIG. 4, designated in FIG. 5 by reference number 301. The cooling system 301 depicted in FIG. 5 is substantially the same as the cooling system 300 depicted in FIG. 4, except as described below. The following description refers to FIGS. 1 and 5, collectively.

The chassis of the cooling system 301 includes a member 331 and a member 333, each formed of a thermally conductive material as described above with respect to the example chassis 330 shown in FIG. 4. The member 331 comprises two substantially cylindrical surfaces 335 extending longitudinally along a longitudinal mating surface 336, perhaps throughout the major dimension of the member 331. The major dimension is the longest external dimension of the member 331, which is perpendicular to the page in FIG. 5. The member 333 comprises two substantially cylindrical surfaces 337 extending longitudinally along a longitudinal mating surface 338, perhaps throughout the major dimension of the member 333. The flowlines 370 (one of which is removed from view in FIG. 5 for the sake of clarity) are each retained between an opposing pair of the substantially cylindrical surfaces 335 and 337.

For example, after positioning the flowlines 370 between the surfaces 335 and 337, the members 331 and 333 are affixed to one another via threaded fasteners, adhesive, and/or other fastening means. Thus, each flowline 370 is in substantially surface contact with one of the substantially cylindrical surfaces 335 of the member 331 and one of the substantially cylindrical surfaces 337 of the member 333. A thermally conductive paste (not shown) may be utilized between each flowline 370 and the corresponding substantially cylindrical surfaces 335 and 337 to aid in eliminating air gaps and increasing thermal conduction between the chassis members 331 and 333 and the flowlines 370. Between and outside the substantially cylindrical surfaces 335 and 337, the mating surfaces 336 and 338 may be substantially planar and thus be in substantially surface contact, although a thermal paste may also be utilized. The chassis member 331 may also comprise one or more additional passages 334 that remain open for routing electrical cables and the like.

The heat-generating electrical components 320 may be mounted to the chassis member 331, as depicted in FIG. 5. However, one or more of the heat-generating electrical components 320 may also overlap the chassis member 333, providing an additional path for heat conduction towards the flowlines 370. The heat-generating electrical components 320 may be flush-mounted to the chassis member 331 and/or the chassis member 333 such that no gap exists between the heat-generating electrical components 320 and the chassis member 331 and/or 333. A thermal paste may also be utilized between the heat-generating components 320 and the chassis member 331 and/or 333.

Figure 6:
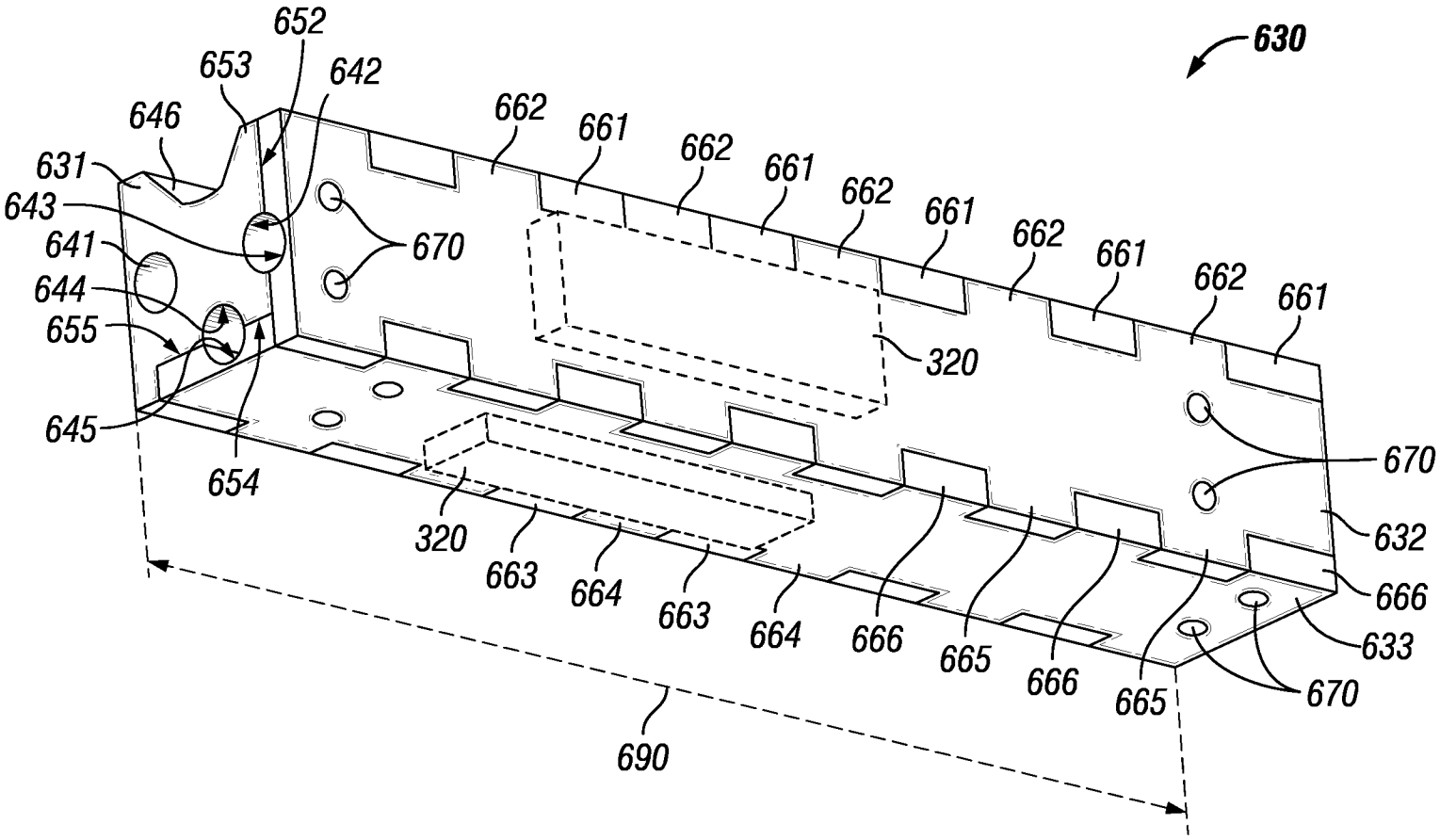
FIG. 6 is a perspective view of another example implementation of a portion of the apparatus shown in FIG. 5 according to one or more aspects of the present disclosure.

FIG. 6 is a perspective view of another example implementation of the chassis shown in FIG. 5, designated in FIG. 6 by reference number 630. Except as described below, the chassis 630 depicted in FIG. 6 is substantially the same as the chassis 330 depicted in FIG. 5. For example, the chassis 630 may be secured within the housing 61 by one or more connection members 350, and may be utilized to transfer heat from heat-generating components 320 to the flowlines 370 extending longitudinally through the chassis 630. The following description refers to FIGS. 1, 5, and 6, collectively.

The chassis 630 comprises a member 631 that is similar to the chassis member 331, and two members 632 and 633 that are each similar to the chassis member 333. The chassis members 632 and 633 may be secured to the chassis member 631 by threaded fasteners 670 and/or other fastening means. A heat-generating electrical component 320 is mounted to the chassis member 632, and another heat-generating electrical component 320 is mounted to the chassis member 633. Each heat-generating electrical component 320 is depicted in FIG. 6 by phantom lines to aid in clarity and understanding. Additional heat-generating electrical components 320 may be mounted to one or more of the chassis members 621, 632, and 633.

The chassis member 631 comprises a substantially cylindrical passage 641 extending longitudinally throughout the major dimension 690 of the chassis 630. The chassis members 631, 632, and 633 may have substantially the same longitudinal length, such that the major dimension 690 of the chassis 630 may also be the major dimension of each of the chassis members 631, 632, and 633. The passage 641 may receive one of the flowlines 370 or be left open for passing electrical cables and the like. A substantially cylindrical surface 642 extends into a longitudinal mating surface 652 of the chassis member 631, and a substantially cylindrical surface 643 extends into a longitudinal mating surface 653 of the chassis member 632. The substantially cylindrical surfaces 642 and 643 each extend longitudinally throughout the major dimension 690 of the chassis 630, and cooperatively retain one of the flowlines 370 in substantially surface contact in the manner as described above with respect to the substantially cylindrical surfaces 335 and 337 shown in FIG. 5. A substantially cylindrical surface 644 extends into a longitudinal mating surface 654 of the chassis member 631, and a substantially cylindrical surface 645 extends into a longitudinal mating surface 655 of the chassis member 633. The substantially cylindrical surfaces 644 and 645 also extend longitudinally throughout the major dimension 690 of the chassis 630, and cooperatively retain another of the flowlines 370 in substantially surface contact in the manner as described above with respect to the substantially cylindrical surfaces 335 and 337 shown in FIG. 5. The chassis 630 may also comprise one or more additional passages 646 that remain open for routing electrical cables and the like.

The chassis members 631, 632, and 633 may also have intermeshing castellated features. For example, a castellated feature of the chassis member 631 may comprise longitudinally spaced tabs 661, and a castellated feature of the chassis member 632 may comprise longitudinally spaced tabs 662. The tabs 661 of the chassis member 631 are disposed within the recesses between the tabs 662 of the chassis member 632, and the tabs 662 of the chassis member 632 are disposed within the recesses between the tabs 661 of the chassis member 631, such that the tabs 661 of the chassis member 631 and the tabs 662 of the chassis member 632 may intermesh. Similarly, another castellated feature of the chassis member 631 may comprise longitudinally spaced tabs 663, and a castellated feature of the chassis member 633 may comprise longitudinally spaced tabs 664, such that the tabs 663 and 664 of the chassis members 631 and 633, respectively, may also form intermeshing castellated features. In this same manner, another castellated feature of the chassis member 632 may comprise longitudinally spaced tabs 665, and another castellated feature of the chassis member 633 may comprise longitudinally spaced tabs 666, such that the tabs 665 and 666 of the chassis members 632 and 633, respectively, may also form intermeshing castellated features.

The intermeshing castellated features of the chassis members 631, 632, and 633 may not provide a tight, interlocking arrangement. For example, gaps may exist between some or each of the tabs of the intermeshing castellated features, which may simplify the assembly process and/or permit looser manufacturing tolerances. In other implementations, many or each of the tabs of the intermeshing castellated features may contact each neighboring tab. Such implementations may provide additional heat transfer conduction paths between the heat-generating electrical components 320 and the flowlines 370. For example, heat generated by the heat-generating electrical component 320 mounted to the chassis member 632 may be conducted through the chassis member 632 to the flowline retained between the substantially cylindrical surfaces 642 and 643 of the chassis members 631 and 632, respectively, and may also be conducted through the chassis member 632 and the chassis member 633 to the flowline retained between the substantially cylindrical surfaces 644 and 645 of the chassis members 631 and 633, respectively. As described above, the heat dissipation attainable by the cooling systems of the present disclosure is increased by greater heat transfer between the heat-generating electrical components 320 and the flowlines retained within the substantially cylindrical surfaces/passages of the thermally conductive chassis.

The example implementations described above generally related to a chassis member substantially comprising thermally conductive material, and a flowline retained in a substantially cylindrical surface of the chassis member. However, in other implementations within the scope of the present disclosure, the flowline may be retained in a surface of the chassis member that is not substantially cylindrical, such as implementations in which the flowline is retained in a surface of the chassis member that is at least partially defined by planar or otherwise non-cylindrical portions.

In view of the entirety of the present disclosure, including the figures and the claims, a person having ordinary skill in the art will readily recognize that the present disclosure introduces an apparatus comprising: a downhole tool for conveyance within a wellbore extending into a subterranean formation, wherein the downhole tool comprises: a housing; a flowline extending within the housing; a chassis comprising: a member substantially comprising thermally conductive material, wherein the flowline is retained in a substantially cylindrical surface of the member; and a heat-generating electrical component mounted to the member.

Fluid flow through the flowline may dissipate heat transferred from the heat-generating electrical component to the fluid flow through the member and the flowline.

The substantially cylindrical surface of the member may longitudinally extend substantially through a major dimension of the member.

The flowline may be retained in substantially surface contact with the substantially cylindrical surface of the member.

The thermally conductive material may have a thermal conductivity of at least 100 Watts/meter/° Kelvin.

The member may be a first member and the chassis may further comprise a second member substantially comprising thermally conductive material and coupled with a longitudinal surface of the first member. In such implementations, the substantially cylindrical surface may be a first substantially cylindrical surface, the second member may comprise a second substantially cylindrical surface, and the flowline may be retained by and between the first and second substantially cylindrical surfaces. The second substantially cylindrical surface may longitudinally extend substantially through a major dimension of the second member. The flowline may be retained in substantially surface contact with the first and second substantially cylindrical surfaces. The heat-generating electrical component may be a first heat-generating electrical component and the downhole tool may further comprise a second heat-generating electrical component mounted to the second member. Fluid flow through the flowline may dissipate heat transferred from the first heat-generating electrical component to the fluid flow through the first member and the flowline, and may dissipate heat transferred from the second heat-generating electrical component to the fluid flow through at least the second member and the flowline.

The member may be a first member and the chassis may further comprise: a second member substantially comprising thermally conductive material and coupled with a first longitudinal surface of the first member; and a third member substantially comprising thermally conductive material and coupled with a second longitudinal surface of the first member. In such implementations, the flowline may be a first flowline, the downhole tool may further comprise a second flowline extending within the housing, the substantially cylindrical surface may be a first substantially cylindrical surface, the first member may comprise a second substantially cylindrical surface, the second member may comprise a third substantially cylindrical surface, the third member may comprise a fourth substantially cylindrical surface, the first flowline may be retained by and between the first and third substantially cylindrical surfaces, and the second flowline may be retained by and between the second and fourth substantially cylindrical surfaces. The first flowline may be retained in substantially surface contact with the first and third substantially cylindrical surfaces, and the second flowline may be retained in substantially surface contact with the second and fourth substantially cylindrical surfaces. The heat-generating electrical component may be a first heat-generating electrical component and the downhole tool may further comprise: a second heat-generating electrical component mounted to the second member; and a third heat-generating electrical component mounted to the third member. First fluid flow through the first flowline may dissipate heat transferred from the first heat-generating electrical component to the first fluid flow through the first member and the first flowline, and may dissipate heat transferred from the second heat-generating electrical component to the first fluid flow through at least the second member and the first flowline, and second fluid flow through the second flowline may dissipate heat transferred from the third heat-generating electrical component to the second fluid flow through at least the third member and the second flowline.

The downhole tool may further comprise: a fluid communicator operable to establish fluid communication with the subterranean formation; a pump operable to pump fluid from the subterranean formation into the flowline via the fluid communicator; an exit port for fluid communication with the wellbore; a sample chamber; and a valve operable to direct fluid pumped into the flowline by the pump to a selective one of the exit port and the sample chamber, wherein the flowline may extend at least between the pump and the valve. The downhole tool may further comprise a downhole fluid analyzer through which the flowline extends.

The present disclosure also introduces a method comprising: conveying a downhole tool within a wellbore extending into a subterranean formation, wherein the downhole tool comprises: a housing; a flowline extending within the housing; a chassis comprising a member substantially comprising thermally conductive material, wherein the flowline is retained in a substantially cylindrical surface of the member; and a heat-generating electrical component mounted to the member; and pumping a fluid from the subterranean formation through the flowline to dissipate heat transferred from the heat-generating electrical component to the fluid through the member and the flowline.

The flowline may be a first flowline, the member may be a first member, the substantially cylindrical surface may be a first substantially cylindrical surface, the heat-generating electrical component may be a first heat-generating electrical component, the first member may comprise a second substantially cylindrical surface, and the chassis may further comprise: a second member substantially comprising thermally conductive material and coupled with a first longitudinal surface of the first member; and a third member substantially comprising thermally conductive material and coupled with a second longitudinal surface of the first member. The second member may comprise a third substantially cylindrical surface, the third member may comprise a fourth substantially cylindrical surface, the first flowline may be retained by and between the first and third substantially cylindrical surfaces, and the downhole tool may further comprise: a second flowline extending within the housing and retained by and between the second and fourth substantially cylindrical surfaces; a second heat-generating electrical component mounted to the second member; and a third heat-generating electrical component mounted to the third member. Pumping the fluid from the subterranean formation may comprise pumping the fluid through the first and second flowlines to dissipate heat transferred from the first, second, and third heat-generating electrical components to the fluid in the first and second flowlines through corresponding ones of the first, second, and third members and the first and second flowlines. In such implementations, first fluid flow through the first flowline may dissipate heat transferred from the first heat-generating electrical component to the first fluid flow through the first member and the first flowline, and may dissipate heat transferred from the second heat-generating electrical component to the first fluid flow through at least the second member and the first flowline, and second fluid flow through the second flowline may dissipate heat transferred from the third heat-generating electrical component to the second fluid flow through at least the third member and the second flowline.

The downhole tool may further comprise: a fluid communicator; a pump; an exit port for fluid communication with the wellbore; a sample chamber; and a valve operable to fluidly connect the flowline with a selective one of the exit port and the sample chamber, wherein the flowline may extend at least between the pump and the valve; and the method may further comprise establishing fluid communication between the downhole tool and the subterranean formation via the fluid communicator. Pumping the fluid from the subterranean formation may comprise operating the pump to pump the fluid from the subterranean formation, via the fluid communicator, into the flowline and either through the exit port or into the sample chamber via the valve. The downhole tool may further comprise a downhole fluid analyzer through which the flowline extends, and the method may further comprise controlling the valve to switch between directing fluid from the flowline through the exit port to directing fluid from the flowline into the sample chamber based on information generated by the downhole fluid analyzer.

The present disclosure also introduces an apparatus comprising: a housing; a flowline extending within the housing; a member retained within the housing and substantially comprising thermally conductive material, wherein the flowline is retained in a substantially cylindrical surface of the member; and a heat-generating electrical component mounted to the member.

Fluid flow through the flowline may dissipate heat transferred from the heat-generating electrical component to the fluid flow through the member and the flowline.

The thermally conductive material may have a thermal conductivity of at least 100 Watts/meter/° Kelvin.

The may be a downhole tool further comprising: a fluid communicator operable to establish fluid communication with a subterranean formation; a pump operable to pump fluid from the subterranean formation into the flowline via the fluid communicator; an exit port for fluid communication with a wellbore extending into the subterranean formation; a sample chamber; and a valve operable to direct fluid pumped into the flowline by the pump to a selective one of the exit port and the sample chamber, wherein the flowline may extend at least between the pump and the valve.

The foregoing outlines features of several embodiments so that a person having ordinary skill in the art may better understand the aspects of the present disclosure. A person having ordinary skill in the art should appreciate that they may readily use the present disclosure as a basis for designing or modifying other processes and structures for carrying out the same functions and/or achieving the same benefits of the embodiments introduced herein. A person having ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to permit the reader to quickly ascertain the nature of the technical disclosure. It is submitted with the understanding that it will not be used to interpret or limit the scope or meaning of the claims.

What is claimed is:

1. An apparatus for thermal management in a wellbore, comprising:

a downhole tool for conveyance within the wellbore extending into a subterranean formation, wherein the downhole tool comprises:

a housing;

a flowline extending within the housing;

a chassis comprising:

a first member and a second member, wherein each member has a plurality of longitudinally spaced tabs, and wherein the tabs of the first member intermesh with tabs on the second member to hold the members together, and wherein the two members substantially comprise thermally conductive material, wherein the flowline is retained in a substantially cylindrical passage, and wherein the substantially cylindrical passage is formed by substantially cylindrical surfaces located on a matting surface of the first member and substantially cylindrical surface on a matting surface of the second member, and wherein the substantially cylindrical surfaces extend longitudinally on the matting surfaces; and a heat-generating electrical component mounted to the first member wherein heat generated by the heat-generating electrical component is dissipated by a fluid from the subterranean formation that flows through the flowline and exits the downhole tool into the wellbore.

2. The apparatus of claim 1 wherein the substantially cylindrical surface of the first member longitudinally extends substantially through a major dimension of the first member.

3. The apparatus of claim 1 wherein the flowline is retained in substantially surface contact with the substantially cylindrical passage.

4. The apparatus of claim 1 wherein the thermally conductive material has a thermal conductivity of at least 100 Watts/meter/° Kelvin.

5. The apparatus of claim 1 wherein:

the heat-generating electrical component is a first heat-generating electrical component;

the downhole tool further comprises a second heat-generating electrical component mounted to the second member; and fluid flow through the flowline:

dissipates heat transferred from the first heat-generating electrical component to the fluid flow through the first member and the flowline; and dissipates heat transferred from the second heat-generating electrical component to the fluid flow through at least the second member and the flowline.

6. The apparatus of claim 1 wherein a plurality of substantially cylindrical surfaces are on the matting surface of the first member and a plurality of substantially cylindrical surfaces on the matting surface of the second member, and wherein the substantially cylindrical surfaces on the matting surface of the first member are arranged thereon to align with the substantially cylindrical surfaces on the matting surface of the second member to form a plurality of substantially circular passages, when the first member and the second member are connected together.

7. A method for thermal management in a wellbore, comprising:

conveying a downhole tool within the wellbore extending into a subterranean formation, wherein the downhole tool comprises:

a housing;

a flowline extending within the housing;

a first member and a second member, wherein each member has a plurality of longitudinally spaced tabs, and wherein the tabs of the first member intermesh with tabs on the second member to hold the members together, and wherein the two members substantially comprise thermally conductive material, wherein the flowline is retained in a substantially cylindrical passage, and wherein the substantially cylindrical passage is formed by substantially cylindrical surfaces located on a matting surface of the first member and substantially cylindrical surface on a matting surface of the second member, and wherein the substantially cylindrical surfaces extend longitudinally on the matting surfaces; and a heat-generating electrical component mounted to the first member;

pumping a fluid from the subterranean formation through the flowline; and dissipating heat transferred from the heat-generating electrical component to the fluid through the first member and the flowline by pumping the fluid out of the downhole tool into the wellbore.

8. An apparatus for thermal management in a wellbore, comprising:

a housing;

a flowline extending within the housing;

a plurality of members retained within the housing and substantially comprising thermally conductive material, wherein the flowline is retained in a substantially cylindrical surface of a matting surface of a first member of the plurality of members and a matting surface of a second member of the plurality of members, and wherein the members are secured with each other by a plurality of longitudinally spaced tabs, and wherein the flowline extends axially through the member; and a heat-generating electrical component mounted to the first member wherein heat generated by the heat-generating electrical component is dissipated by a fluid from the subterranean formation that flows through the flowline and exits the downhole tool into the wellbore.

9. The apparatus of claim 8 wherein the apparatus is a downhole tool further comprising:

a fluid communicator operable to establish fluid communication with a subterranean formation;

a pump operable to pump fluid from the subterranean formation into the flowline via the fluid communicator;

an exit port for fluid communication with a wellbore extending into the subterranean formation;

a sample chamber; and a valve operable to direct fluid pumped into the flowline by the pump to a selective one of the exit port and the sample chamber, wherein the flowline extends at least between the pump and the valve.

* * * * *